US006248488B1

(12) United States Patent
Kinoshita et al.

(10) Patent No.: US 6,248,488 B1
(45) **Date of Patent: *Jun. 19, 2001**

(54) IMAGE FORMATION METHOD USING COLOR TONERS

(75) Inventors: Nobutaka Kinoshita; Mitsuo Aoki; Shinichi Kuramoto; Akira Oyamaguchi; Hiroshi Sugimoto, all of Shizuoka (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/231,769

(22) Filed: Jan. 15, 1999

(30) Foreign Application Priority Data

Jan. 16, 1998 (JP) ..... 10-006606

(51) Int. Cl.[7] ..... G03G 13/01
(52) U.S. Cl. ..... 430/45; 430/111; 430/124
(58) Field of Search ..... 430/42, 45, 124, 430/106, 111, 97, 110, 126, 47

(56) References Cited

U.S. PATENT DOCUMENTS

| | | | | |
|---|---|---|---|---|
| 5,501,931 | * | 3/1996 | Hirama et al. | 430/124 |
| 5,637,427 | * | 6/1997 | Yamamoto et al. | 430/45 |
| 5,733,701 | * | 3/1998 | Anno et al. | 430/110 |
| 5,738,962 | * | 4/1998 | Ichimura et al. | 430/45 |
| 5,840,457 | * | 11/1998 | Urawa et al. | 430/45 |
| 6,074,794 | * | 6/2000 | Fushimi et al. | 430/109 |

* cited by examiner

*Primary Examiner*—Janis L. Dote
(74) *Attorney, Agent, or Firm*—Oblon, Spivak, McClelland, Maier & Neustadt, P.C.

(57) ABSTRACT

A method of forming images on an image receiving material including a non-contact thermal fusing image fixing step employs a black toner made of black toner particles, a yellow toner made of yellow toner particles, a magenta toner made of magenta toner particles and a cyan toner made of cyan toner particles, the black toner particles having a greater volume mean diameter than the volume mean diameter of the toner particles of any of the yellow toner, the magenta toner and the cyan toner.

4 Claims, 1 Drawing Sheet

FIGURE
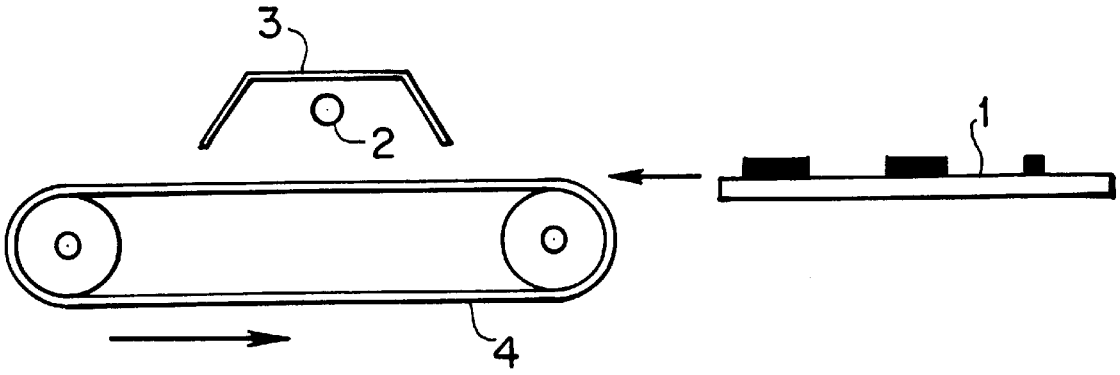

IMAGE FORMATION METHOD USING COLOR TONERS

BACKGROUND OF THE INVENTION

1. Field of the Invention

The present invention relates to an image formation method capable of producing a full-color image by superimposing four yellow, magenta, cyan and black toner images using a set of color toners, in particular, full-color two-component dry developers.

2. Discussion of Background

According to the electrophotographic process, a latent electrostatic image is formed on the surface of a photoconductor comprising a photoconductive material, and the latent electrostatic image is developed to a visible image with a developer. The thus obtained visible toner image is, when necessary, transferred to a sheet of paper and fixed thereon under the application of heat and pressure.

To obtain a full-color image, an original color image is exposed to light using a color separation filter. Alternatively, an original color image is subjected to color scanning using a scanner to prepare four separations, and a latent image is formed from each separation using a laser beam according to the color separation data. Then, the latent image thus formed is developed to a full-color image by superimposing a yellow toner image, a magenta toner image and a cyan toner image.

The conventional toner for electrophotographic use is prepared by kneading a mixture of a thermoplastic resin, a pigment and a charge control agent and pulverizing the kneaded mixture. In a set of conventional color toners made of yellow, magenta, cyan and black toners, any color toner particles have the same particle diameters. To make the toner particles smaller, the steps of pulverizing and classification need much more time, and accordingly, the manufacturing cost is increased.

In the conventional electrophotographic process, the most common method for fixing the toner image transferred to an image receiving material such as a sheet of paper is a heat roller image fixing method, that is, a contact thermal fusing image fixing method. In this case, however, the pressure by a heat roller cannot be uniformly applied to the entire surface of paper when the paper size is large, causing the paper to become creased when passing through the heat roller. In addition, the pressure applied to the image receiving material by the conventionally used heat roller is relatively strong, so that the toner image formed on the image receiving material may be deformed, thereby decreasing the resolution. Further, the glossiness of the obtained toner image tends to become uneven.

Even though there is employed an oven image fixing method, which is one of the non-contact thermal fusing image fixing methods, only the black toner image shows excessive glossiness because the thermal absorption of black toner particles is large. Thus, the obtained full-color image is lacking in evenness of the glossiness.

For example, as disclosed in Japanese Laid-Open Patent Application 9-190013, there is proposed a dry toner for use in electrophotography, which comprises a coloring agent and a binder resin comprising a resin component (a) and a resin component (b) of which glass transition temperature is different from that of the resin component (a) by less than 5° C. According to this application, clear images can be produced when a toner image comprising such a dry toner is fixed to an image receiving material by any of the contact thermal fusing image fixing method or the non-contact thermal fusing image fixing method.

A dry toner disclosed in Japanese Laid-Open Patent Application 6-282102 comprises a binder resin which comprises a resin component (a') and a resin component (b'), the glass transition temperatures of both resin components (a') and (b') being higher than 45° C., and the glass transition temperature of the resin component (a') being lower than that of the resin component (b') by at least 2.5° C. It is described that a toner image obtained from such a toner can exhibit excellent fusing characteristics even when fixed to an image receiving material by the non-contact thermal fusing image fixing method.

However, the above-mentioned conventional dry toners cannot meet all the following requirements:

(1) excellent spectral reflectance and clear color for satisfactory color reproduction, (2) sufficient dispersibility of a coloring agent with a binder resin for high coloring performance, (3) high light resistance, (4) stable triboelectic charging characteristics regardless of the change in environmental conditions, (5) minimum occurrence of the so-called spent toner phenomenon when used as a two-component developer, and (6) capable of exhibiting even glossiness when a color image is produced.

In particular, the conventional full-color toners have many practical problems with respect to the control of transparency and glossiness.

SUMMARY OF THE INVENTION

Accordingly, an object of the present invention is to provide an image formation method capable of producing full-color images with even glossiness without the spent toner phenomenon.

The above-mentioned object of the present invention can be achieved by a method of forming images on an image receiving material, comprising a non-contact thermal fusing image fixing step, using a black toner comprising black toner particles, a yellow toner comprising yellow toner particles, a magenta toner comprising magenta toner particles and a cyan toner comprising cyan toner particles, the black toner particles having a greater volume mean diameter than the volume mean diameter of the toner particles of any of the yellow toner, the magenta toner and the cyan toner.

In particular, it is preferable that the volume mean diameter of the black toner particles be in a range of 1.05 to 1.25 times the volume mean diameter of any of the yellow toner particles, the magenta toner particles and the cyan toner particles.

In addition, it is preferable that the volume mean diameter of the black toner particles be in a range of 7 to 10 $\mu$m, while the volume mean diameter of each of the yellow toner particles, the magenta toner particles and the cyan toner particles be in a range of 5 to 8 $\mu$m.

Further, each of the black, yellow, magenta and cyan toners may comprise toner particles with a volume mean diameter of 4 $\mu$m or less in a number of 30% or less of the entire number of toner particles in each of the toners.

The above-mentioned image formation method may further comprise a step of electrically or magnetically depositing the toners on or transferring the images to the image receiving material prior to the non-contact thermal fusing image fixing step.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein:

a single FIGURE is a schematic diagram which shows the structure of a non-contact thermal fusing image fixing unit for use in the present invention.

DESCRIPTION OF THE PREFERRED EMBODIMENTS

According to the present invention, the volume mean diameter of black toner particles constituting a black toner is greater than the volume mean diameter of the toner particles of any of a yellow toner, a magenta toner, and a cyan toner. Therefore, the thermal conductivity of the toner particles can be controlled as a whole, so that the glossiness of a black toner image made of black toner particles is stable and well-matched with that of any of a yellow toner image, a magenta toner image and a cyan toner image.

The obtained toner image can effectively maintain a good balance in the glossiness of different color images when the volume mean diameter of the black toner particles is 1.05 to 1.25 times, preferably 1.10 to 1.20 times, the volume mean diameter of any of the yellow toner particles, the magenta toner particles and the cyan toner particles. When the volume mean diameter of the black toner particles is greater than those of yellow, magenta and cyan toner particles to such a degree, the glossiness of the black toner image can be properly controlled.

Further, it is preferable that the volume mean diameter of the black toner particles be in a range of 7 to 10 $\mu$m; while the volume mean diameter of each of the yellow toner particles, the magenta toner particles and the cyan toner particles be in a range of 5 to 8 $\mu$m. In this case, the spent toner can be prevented when the color toners are used as two-component developers, and therefore, the life of each color developer can be extended, and the image quality of the obtained toner image can be improved.

In addition, it is preferable that each of the black, yellow, magenta and cyan toners comprise toner particles with a volume mean diameter of 4 $\mu$m or less in a number of 30% or less of the entire number of toner particles in each of the toners. In this case, the life of the toner particles can be extended because the spent toner can be effectively prevented, and the glossiness of the obtained color toner image can be easily controlled.

Although the particle size distribution of the toner particles can be measured by various methods, Coulter counter method is employed in the present invention. To be more specific, measurement is carried out using a commercially available measuring apparatus "COULTER COUNTER MODEL TA II" (Trademark), made by Coulter Electronics Limited with the aperture being set to 100 $\mu$m and a 1% aqueous solution of sodium chloride being used as an electrolyte.

Each color toner for use in the present invention comprises a binder resin and a coloring agent, and further a charge control agent when necessary.

Any resins for use in the conventional toners may be used alone or in combination. Alternatively, polymer alloys and modified polymers prepared from such resins may be appropriately selected.

Specific examples of such a binder resin for use in the present invention include styrene polymers and copolymers such as polystyrene, polychlorostyrene, polyvinyltoluene, styrene—vinyltoluene copolymer, styrene—vinylnaphthalene copolymer, styrene—acrylic acid copolymer, styrene—methacrylic acid copolymer, styrene—acrylonitrile copolymer, styrene—butadiene copolymer, and styrene—maleic acid ester copolymer, acrylic resin, vinyl resin, ethylenic resin, polyamide resin, polyester resin, phenolic resin, silicone resin, xylene resin, epoxy resin, terpene resin, rosin and modified rosin.

Any dyes and pigments for use in the conventional toners can be used as the coloring agents in the present invention.

Specific examples of the dyes and pigments include carbon black, lamp black, iron black, Ultramarine Blue, nigrosine dyes, Aniline Blue, Calconyl Blue, Du Pont Oil Red, Quinoline Yellow, Methylene Blue Chloride, Phthalocyanine Blue, Phthalocyanine Green, Hansa Yellow, Rhodamine 6C Lake, chrome yellow, quinacridone, Benzidine Yellow, Malachite Green, Malachite Green Hexalate, Oil Black, Azo Oil Black, Rose Bengal, monoazo dyes and pigments, disazo dyes and pigments, and trisazo dyes and pigments.

In order to control the chargeability of the color toner for use in the present invention, it is effective that a charge control agent be added to the toner composition.

Examples of the charge control agent for use in the present invention include a nigrosine dye, a quaternary ammonium salt, an amino-group-containing polymer, a metal-containing azo dye, a salicylic acid complex compound, and a phenolic compound. Of these charge control agents, the quaternary ammonium salt, the amino-group-containing polymer and the salicylic acid complex compound are preferable because such charge control agents do not have any adverse effect on the color tone of the obtained color image.

In addition, there can be employed additives such as silica, aluminum oxide and titanium oxide. For the purpose of imparting high fluidity to the toner particles, hydrophobic silica or titanium oxide particles with rutile structure with an average primary particle size of 0.001 to 1 $\mu$m, preferably 0.005 to 0.1 $\mu$m may be appropriately selected. In particular, silica or titania surface-treated with an organic silane compound is preferably employed as the fluidity imparting agent. It is preferable that the amount of such a fluidity imparting agent be in a range of 0.1 to 5 wt. %, more preferably in a range of 0.2 to 2 wt. % of the total weight of the toner particles.

When the color toner for use in the present invention is used as a two-component dry developer, there can be employed as a carrier component finely-divided particles of glass, iron, ferrite, nickel, zircon or silica having a particle diameter of about 30 to 1000 $\mu$m, The surfaces of those finely-divided particles may be coated with a resin such as styrene—acrylic resin, a silicone resin, a polyamide resin, or a polyvinylidene fluoride resin.

Other features of this invention will become apparent in the course of the following description of exemplary embodiments, which are given for illustration of the invention and are not intended to be limiting thereof.

EXAMPLE 1

A mixture of 93 parts by weight of a polyol resin, 2 parts by weight of a negative charge control agent, and 5 parts by weight of a monoazo yellow pigment was fused and kneaded in a two-roll kneader. The thus kneaded mixture was cooled and roughly ground in a hammer mill, and the obtained particles were passed through a screen of 2-mm mesh. Thus, yellow toner particles (Y11) were obtained.

The procedure for preparation of the yellow toner particles (Y11) as mentioned above was repeated except that the amount ratios of the polyol resin and the coloring agent were changed as shown in Table 1 and the monoazo yellow pigment serving as the coloring agent for the yellow toner was replaced by a quinacridone magenta pigment, a phthalocyanine cyan pigment, and a carbon black, so that magenta toner particles (M11), cyan toner particles (C11) and black toner particles (Bk11) were respectively prepared.

TABLE 1

| | Y11 | M11 | C11 | Bk11 |
|---|---|---|---|---|
| Polyol resin (parts by weight) | 93 | 92 | 94 | 94 |
| Negative charge control agent (parts by weight) | 2 | 2 | 2 | 2 |
| Coloring agent (parts by weight) | | | | |
| Monoazo yellow pigment | 5 | — | — | — |
| Quinacridone magenta pigment | — | 6 | — | — |
| Phthalocyanine cyan pigment | — | — | 4 | — |
| Carbon black | — | — | — | 4 |

The above prepared toner particles (Y11), (M11), (C11) and (Bk11) were separately pulverized using a commercially available pulverizer (Trademark "SUPER SONIC JET MILL (Type IDS-2)", made by Nippon Pneumatic Mfg. Co., Ltd.), and classified in a classifier so as to have toner particles (Y21), (M21), (C21) and (Bk21) with such a particle size distribution as shown in Table 2.

TABLE 2

| | Y21 | M21 | C21 | Bk21 |
|---|---|---|---|---|
| Volume mean diameter (μm) | 8.6 | 8.5 | 8.6 | 11.4 |
| Ratio of volume mean diameter of (Bk21) to volume mean diameter of (Y21), (M21) or (C21) | 1.32 | 1.34 | 1.33 | — |
| Ratio of toner particles with a volume mean diameter of 4 μm or less in terms of the number of particles (%) | 23 | 25 | 24 | 35 |

10 g of surface-treated silica was added to each toner particles (Y21), (M21), (C21) or (Bk21) in an amount of 2 kg, and the resultant mixture was blended in a 20-l Henschel mixer. Thus, yellow toner particles (Y31), magenta toner particles (M31), cyan toner particles (C31) and black toner particles (Bk31) for use in the present invention were obtained.

EXAMPLE 2

The yellow toner particles (Y11), the magenta toner particles (M11), the cyan toner particles (C11) and the black toner particles (Bk11) were prepared in the same manner as in Example 1.

The thus prepared yellow toner particles (Y11), magenta toner particles (M11), cyan toner particles (C11) and black toner particles (Bk11) were separately pulverized using a commercially available pulverizer (Trademark "SUPER SONIC JET MILL (Type IDS-2)", made by Nippon Pneumatic Mfg. Co., Ltd.), and classified in a classifier so as to have toner particles (Y22), (M22), (C22) and (Bk22) with such a particle size distribution as shown in Table 3.

TABLE 3

| | Y22 | M22 | C22 | Bk22 |
|---|---|---|---|---|
| Volume mean diameter (μm) | 9.0 | 9.1 | 9.1 | 10.5 |
| Ratio of volume mean diameter of (Bk21) to volume mean diameter of (Y21), (M21) or (C21) | 1.17 | 1.15 | 1.15 | — |
| Ratio of toner particles with a volume mean diameter of 4 μm or less in terms of the number of particles (%) | 21 | 19 | 18 | 38 |

10 g of surface-treated silica was added to each toner particles (Y22), (M22), (C22) or (Bk22) in an amount of 2 kg, and the resultant mixture was blended in a 20-l Henschel mixer. Thus, yellow toner particles (Y32), magenta toner particles (M32), cyan toner particles (C32) and black toner particles (Bk32) for use in the present invention were obtained.

EXAMPLE 3

The yellow toner particles (Y11), the magenta toner particles (M11), the cyan toner particles (C11) and the black toner particles (Bk11) were prepared in the same manner as in Example 1.

The thus prepared yellow toner particles (Y11), magenta toner particles (M11), cyan toner particles (C11) and black toner particles (Bk11) were separately pulverized using a commercially available pulverizer (Trademark "SUPER SONIC JET MILL (Type IDS-2)", made by Nippon Pneumatic Mfg. Co., Ltd.), and classified in a classifier so as to have toner particles (Y23), (M23), (C23) and (Bk23) with such a particle size distribution as shown in Table 4.

TABLE 4

| | Y23 | M23 | C23 | Bk23 |
|---|---|---|---|---|
| Volume mean diameter (μm) | 8.6 | 8.5 | 8.6 | 9.6 |
| Ratio of volume mean diameter of (Bk21) to volume mean diameter of (Y21), (M21) or (C21) | 1.12 | 1.13 | 1.12 | — |
| Ratio of toner particles with a volume mean diameter of 4 μm or less in terms of the number of particles (%) | 23 | 25 | 24 | 31 |

10 g of surface-treated silica was added to each toner particles (Y23), (M23), (C23) or (Bk23) in an amount of 2 kg, and the resultant mixture was blended in a 20-l Henschel mixer. Thus, yellow toner particles (Y33), magenta toner particles (M33), cyan toner particles (C33) and black toner particles (Bk33) for use in the present invention were obtained.

EXAMPLE 4

The yellow toner particles (Y11), the magenta toner particles (M11), the cyan toner particles (C11) and the black toner particles (Bk11) were prepared in the same manner as in Example 1.

The thus prepared yellow toner particles (Y11), magenta toner particles (M11), cyan toner particles (C11) and black toner particles (Bk11) were separately pulverized using a commercially available pulverizer (Trademark "SUPER SONIC JET MILL (Type IDS-2)", made by Nippon Pneumatic Mfg. Co., Ltd.), and classified in a classifier so as to have toner particles (Y24), (M24), (C24) and (Bk24) with such a particle size distribution as shown in Table 5.

TABLE 5

| | Y24 | M24 | C24 | Bk24 |
|---|---|---|---|---|
| Volume mean diameter (μm) | 7.3 | 7.2 | 7.3 | 8.6 |
| Ratio of volume mean diameter of (Bk21) to volume mean diameter of (Y21), (M21) or (C21) | 1.18 | 1.19 | 1.18 | — |
| Ratio of toner particles with a volume mean diameter of 4 μm or less in terms of the number of particles (%) | 31 | 33 | 31 | 31 |

10 g of surface-treated silica was added to each toner particles (Y24), (M24), (C24) or (Bk24) in an amount of 2 kg, and the resultant mixture was blended in a 20-l Henschel mixer. Thus, yellow toner particles (Y34), magenta toner particles (M34), cyan toner particles (C34) and black toner particles (Bk34) for use in the present invention were obtained.

EXAMPLE 5

The yellow toner particles (Y11), the magenta toner particles (M11), the cyan toner particles (C11) and the black toner particles (Bk11) were prepared in the same manner as in Example 1.

The thus prepared yellow toner particles (Y11), magenta toner particles (M11), cyan toner particles (C11) and black toner particles (Bk11) were separately pulverized using a commercially available pulverizer (Trademark "SUPER SONIC JET MILL (Type IDS-2)", made by Nippon Pneumatic Mfg. Co., Ltd.), and classified in a classifier so as to have toner particles (Y25), (M25), (C25) and (Sk25) with such a particle size distribution as shown in Table 6.

TABLE 6

| | Y25 | M25 | C25 | Bk25 |
|---|---|---|---|---|
| Volume mean diameter (μm) | 7.1 | 7.0 | 7.1 | 8.0 |
| Ratio of volume mean diameter of (Bk21) to volume mean diameter of (Y21), (M21) or (C21) | 1.13 | 1.14 | 1.13 | — |
| Ratio of toner particles with a volume mean diameter of 4 μm or less in terms of the number of particles (%) | 31 | 32 | 31 | 26 |

10 g of surface-treated silica was added to each toner particles (Y25), (M25), (C25) or (Bk25) in an amount of 2 kg, and the resultant mixture was blended in a 20-l Henschel mixer. Thus, yellow toner particles (Y35), magenta toner particles (M35), cyan toner particles (C35) and black toner particles (Bk35) for use in the present invention were obtained.

Comparative Example 1

The yellow toner particles (Y11), the magenta toner particles (M11), the cyan toner particles (C11) and the black toner particles (Bk11) were prepared in the same manner as in Example 1.

The thus prepared yellow toner particles (Y11), magenta toner particles (M11), cyan toner particles (C11) and black toner particles (Bk11) were separately pulverized using a commercially available pulverizer (Trademark "SUPER SONIC JET MILL (Type IDS-2)", made by Nippon Pneumatic Mfg. Co., Ltd.), and classified in a classifier so as to have toner particles (Y26), (M26), (C26) and (Bk26) with such a particle size distribution as shown in Table 7.

TABLE 7

| | Y26 | M26 | C26 | Bk26 |
|---|---|---|---|---|
| Volume mean diameter (μm) | 9.0 | 9.1 | 9.1 | 8.0 |
| Ratio of volume mean diameter of (Bk21) to volume mean diameter of (Y21), (M21) or (C21) | 0.89 | 0.88 | 0.88 | — |
| Ratio of toner particles with a volume mean diameter of 4 μm or less in terms of the number of particles (%) | 21 | 19 | 18 | 26 |

10 g of surface-treated silica was added to each toner particles (Y26), (M26), (C26) or (Bk26) in an amount of 2 kg, and the resultant mixture was blended in a 20-l Henschel mixer. Thus, comparative yellow toner particles (Y36), magenta toner particles (M36), cyan toner particles (C36) and black toner particles (Bk36) were obtained.

Comparative Example 2

The yellow toner particles (Y11), the magenta toner particles (M11), the cyan toner particles (C11) and the black toner particles (Bk11) were prepared in the same manner as in Example 1.

The thus prepared yellow toner particles (Y11), magenta toner particles (M11), cyan toner particles (C11) and black toner particles (Bk11) were separately pulverized using a commercially available pulverizer (Trademark "SUPER SONIC JET MILL (Type IDS-2)", made by Nippon Pneumatic Mfg. Co., Ltd.), and classified in a classifier so as to have toner particles (Y27), (M27), (C27) and (Bk27) with such a particle size distribution as shown in Table 8.

TABLE 8

| | Y27 | H27 | C27 | Bk27 |
|---|---|---|---|---|
| Volume mean diameter (μm) | 7.5 | 7.2 | 7.3 | 7.2 |
| Ratio of volume mean diameter of (Bk21) to volume mean diameter of (Y21), (M21) or (C21) | 0.96 | 1.00 | 0.99 | — |
| Ratio of toner particles with a volume mean diameter of 4 μm or less in terms of the number of particles (%) | 31 | 35 | 33 | 23 |

10 g of surface-treated silica was added to each toner particles (Y27), (M27), (C27) or (Bk27) in an amount of 2 kg, and the resultant mixture was blended in a 20-l Henschel mixer. Thus, comparative yellow toner particles (Y37), magenta toner particles (M37), cyan toner particles (C37) and black toner particles (Bk37) were obtained.

[Preparation of Two-component Dry Developer]

5 parts by weight of each toner particles prepared in Examples 1 to 5 and Comparative Examples 1 and 2 were mixed with 95 parts by weight of silicone-resin coated carrier particles with a particle diameter of about 80 μm, and the resultant mixture was stirred, so that a two-component dry developer was obtained.

[Evaluation of Color Toner Image]

The two-component dry developers of four colors (yellow, magenta, cyan and black) obtained in each Example and Comparative Example were set in a commercially available electrophotographic full-color copier for plain paper (Trademark "PRETER 550", made by Ricoh Company, Ltd.), and each color toner image was separately obtained and transferred to plain paper.

Before the transferred color toner image was fixed onto the plain paper, the image-bearing plain paper was taken out of the copier. The color toner image transferred to the plain paper was fixed thereto using a non-contact thermal fusing image fixing unit as shown in the single figure.

In the image fixing unit as shown in the figure, a color toner image transferred to a plain paper 1 was transported at a linear speed of 200 mm/sec along a transporting belt 4 in a direction of arrow, and fused when the image-bearing plain paper passed through a halogen lamp 2 with a color temperature of 2500° K which was not in contact with the image-bearing plain paper, whereby image fixing was completed.

In the figure, reference numeral 3 indicates a lamp cover.

The glossiness of each color toner image thus fixed onto the plain paper was measured using a commercially available glossmeter (Trademark "VGS-1D", made by Nippon Denshoku Kogyo Co., Ltd.) at an angle of 60°.

The results are shown in Table 9.

With respect to the phenomenon of spent toner, toner particles were removed from each two-component color developer by blow-off method after making of 100,000 copies, and the weight (w1) of the toner particles was measured. Then, the toner particles were washed with methyl ethyl ketone, and the weight (w2) of the toner particles was measured again. The spent toner occurrence ratio (%) was obtained in accordance with the following formula:

$$\text{Spent Toner Occurence Ratio (\%)} = \frac{(w1) - (w2)}{(w1)} \times 100$$

The results are shown in Table 9.

Furthermore, a sensory test was carried out to evaluate the image quality of the obtained color images using ten panel members. The image quality was evaluated in accordance with the following scale:

◎ (excellent): 8 panel members or more were favourably impressed by the color images.

○ (good): 4 to 7 panel members were favourably impressed by the color images.

x (poor): Only 3 panel members or less were favourably impressed by the color images.

The results are also shown in Table 9.

TABLE 9

| | Glossiness | | | | | Spent Toner Occurrence Ratio (%) | |
|---|---|---|---|---|---|---|---|
| | Yellow image | Magenta image | Cyan image | Black image | Image Quality | Black toner particles | Yellow, magenta and cyan toner particles (average) |
| Ex. 1 | 6.5 | 7.5 | 7.0 | 9.0 | ○ | 0.0020 | 0.0018 |
| Ex. 2 | 6.9 | 7.9 | 7.5 | 9.0 | ○ | 0.0020 | 0.0016 |
| Ex. 3 | 7.8 | 8.3 | 8.3 | 9.0 | ○ | 0.0018 | 0.0015 |
| Ex. 4 | 8.8 | 8.9 | 8.9 | 9.0 | ○–◎ | 0.0015 | 0.0014 |
| Ex. 5 | 8.9 | 9.0 | 9.0 | 9.0 | ◎ | 0.0012 | 0.0011 |
| Comp. Ex. 1 | 4.0 | 4.3 | 4.1 | 8.2 | X | 0.0018 | 0.0017 |
| Comp. Ex. 2 | 6.0 | 7.1 | 6.5 | 8.5 | X | 0.0015 | 0.0017 |

As previously explained, when color toner images comprising a black toner, a yellow toner, a magenta toner and a cyan toner are fixed onto an image receiving material using a non-contact thermal fusing image fixing unit according to the image formation method of the present invention, the glossiness of the black toner image is not too high, and can be well-matched with that of any of yellow, magenta and cyan toner images. This is because the volume mean diameter of the black toner particles is controlled to be greater than the volume mean diameter of any of yellow toner particles, magenta toner particles and cyan toner particles. Therefore, the thermal conductivity of the toner particles can be controlled in the image fixing step.

Japanese Patent Application No. 10-006606 filed Jan. 16, 1998 is hereby incorporated by reference.

What is claimed is:

1. A method of forming images on an image receiving material, comprising:

forming toner images of black, yellow, magenta, and cyan on said image receiving material using black, yellow, magenta, and cyan toners, respectively, and performing non-contact thermal fusing of said toner images on said image receiving material, wherein said black toner comprises black toner particles, said yellow toner comprises yellow toner particles, said magenta toner comprises magenta toner particles and said cyan toner comprises cyan toner particles, said black toner particles having a volume mean diameter in the range of 1.05 to 1.25 times the volume mean diameter of said toner particles of any of said yellow toner, said magenta toner and said cyan toner, wherein each of said black, yellow, magenta and cyan toners comprises toner particles with a volume mean diameter of 4 $\mu$m or less in a number of 30% or less of the entire number of toner particles in each of said toners.

2. The method as claimed in claim 1, wherein said volume mean diameter of said black toner particles is in a range of 7 to 10 $\mu$m.

3. The method as claimed in claim 1, wherein said volume mean diameter of each of said yellow toner particles, said magenta toner particles and said cyan toner particles is in a range of 5 to 8 $\mu$m.

4. The method as claimed in claim 1, further comprising a step of electrically or magnetically depositing said toners on or transferring said images to said image receiving material prior to said non-contact thermal fusing image fixing step.

* * * * *

UNITED STATES PATENT AND TRADEMARK OFFICE

CERTIFICATE OF CORRECTION

PATENT NO. : 6,248,488 B1
DATED : June 19, 2001
INVENTOR(S) : Nobutaka Kinoshita et al.

It is certified that error appears in the above-identified patent and that said Letters Patent is hereby corrected as shown below:

Column 7,
Line 39, "(C25) and (Sk25) with" should read -- (C25) and (Bk25) --.

Column 8,
Line 46, "H27" should read -- M27 --.

Signed and Sealed this

Thirtieth Day of April, 2002

*Attest:*

*Attesting Officer*

JAMES E. ROGAN
*Director of the United States Patent and Trademark Office*